US007780031B2

(12) United States Patent
Pellegrino

(10) Patent No.: US 7,780,031 B2
(45) Date of Patent: Aug. 24, 2010

(54) EMBEDDED PAINT CAN LID REMOVAL DEVICE

(76) Inventor: Joesph Vito Pellegrino, 298 Adam's Way, Sayville, NY (US) 11782

( * ) Notice: Subject to any disclaimer, the term of this patent is extended or adjusted under 35 U.S.C. 154(b) by 372 days.

(21) Appl. No.: 11/900,771

(22) Filed: Sep. 14, 2007

(65) Prior Publication Data

US 2009/0071958 A1 Mar. 19, 2009

(51) Int. Cl.
*B65D 17/52* (2006.01)

(52) U.S. Cl. ..... 220/284

(58) Field of Classification Search ..... 220/260, 220/285, 699, 700, 701, 278, 265, 830, 810, 220/281, 200, 212, 254.2, 254.1, 695, 694, 220/257.2, 257.1, 256.1, 735, FOR. 205, 220/FOR. 204, FOR. 203, 827, 254; 215/305, 215/304, 303, 302, 301, 300, 299, 297, 296, 215/295, 200, 257, 250, 390, 386; 81/3.56, 81/3.55, 3.27, 3.25, 3.07; D9/437, 436, 435
See application file for complete search history.

(56) References Cited

U.S. PATENT DOCUMENTS 1,299,690 A * 4/1919 Demory ..... 215/297
2,537,724 A * 1/1951 Warren, Sr. ..... 30/411
2,760,714 A * 8/1956 Rasmussen ..... 229/125.14
2,866,574 A * 12/1958 Roumeliotis ..... 220/326
4,146,146 A * 3/1979 Mar ..... 215/213
4,512,484 A * 4/1985 Mar ..... 215/221
4,732,288 A * 3/1988 Morris, Sr. ..... 215/214
4,967,926 A * 11/1990 Morris, Sr. ..... 220/323
5,752,612 A * 5/1998 Fritzsche et al. ..... 215/301
5,915,575 A * 6/1999 Morris, Sr. ..... 215/214
6,105,808 A * 8/2000 Mendonca ..... 220/316
6,866,162 B2 * 3/2005 Morris, Sr. ..... 220/288
2007/0039964 A1 * 2/2007 Morris, Sr. ..... 220/302

* cited by examiner

*Primary Examiner*—Anthony Stashick
*Assistant Examiner*—Robert J Hicks

(57) ABSTRACT

A substitute for the rim of a paint can to allow the paint can's lid to be removed without requiring an extra utility. There have been many complaints by individuals that use paint cans that find themselves in situations where they cannot open the can because they do not have a paint can opener, or something to pry the lid open. This device was invented with the intent to remedy this problem.

7 Claims, 1 Drawing Sheet

EMBEDDED PAINT CAN LID REMOVAL DEVICE

BRIEF SUMMARY OF THE INVENTION

It is a device built into the paint can to allow a way of removing the paint can's lid when a screwdriver or other tool isn't available to help. The device uses segment pieces to pop open the lid out of the seal of a paint can's rim by pulling or pushing on a holder piece.

DETAILED DESCRIPTION OF DRAWINGS

Figure 1:
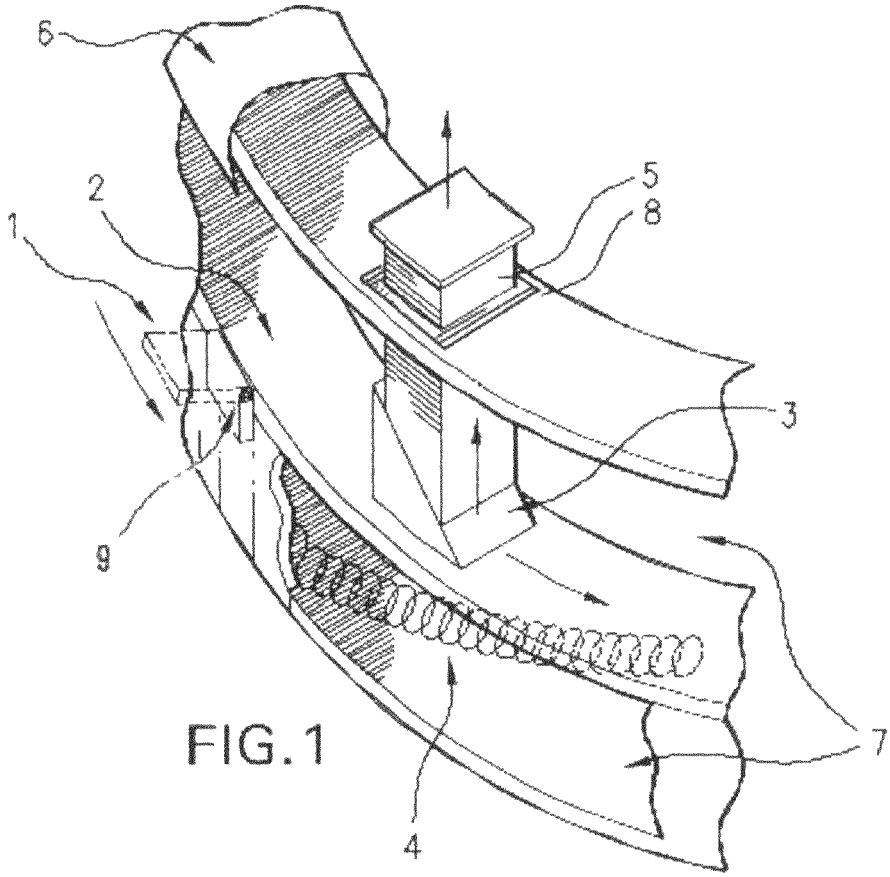
FIG. 1. is a transparent 3D view of the side of the embedded paint can lid removal device.
Figure 2:
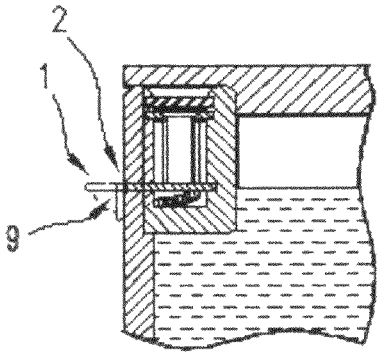
FIG. 2. is a frontal view of the inner chamber before the wedges push the segment pieces upwards.
Figure 3:
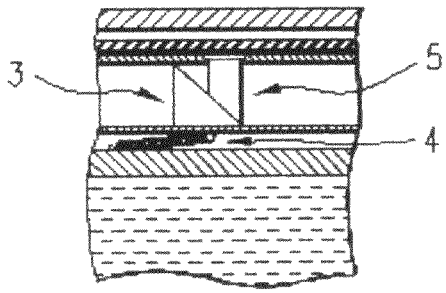
FIG. 3. is a sideward view of the inner chamber before the wedge push the segment pieces upwards.
Figure 4:
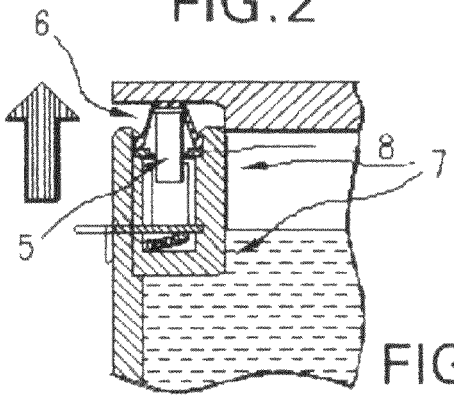
FIG. 4. is a frontal view of the inner chamber after the wedge push the segment pieces upwards.
Figure 5:
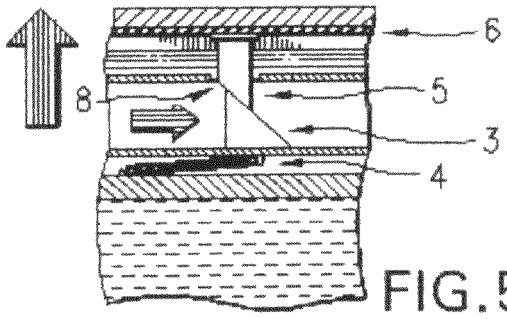
FIG. 5. is a sideward view of the inner chamber after the wedge push the segment pieces upwards.

FIG. 1 is a 3-D side view of the embedded paint can lid removal device showing the holder piece 1, the inner ring 2, the hinge 9, the wedge piece 3, the spring 4, the segment piece with T-shaped top 5, the elastic material (rubber, etc.) covering 6, the inner chamber 7, and hole with L-shaped indents 8 surrounding the segment piece with T-shaped top 5. Referring to FIG. 2 is frontal view of the inner chamber and inner ring 2 connected by a hinge 9 to the holder piece 1 which will be going through the side of the paint can via a slit that is just having enough width to allow the turning of the inner ring 2 with wedge piece 3 from FIG. 1 which in turn will push the T-shaped segment piece 5 upwards stretching the elastic material covering 6 from FIG. 1, pushing the paint can lid away from connected paint can, and then said inner ring 2, will be pulled back into place by the spring 4 in FIG. 1. Referring to FIG. 3 is a side view of the embedded paint can lid removal device showing the wedge piece 3 in position with the segment piece with T-shaped top 5 before it is moved by the turning of the inner ring 2 from the grabbing of the holder piece 1 that runs through the slit through the side wall of the inner chamber and on the side of the paint can. Referring to FIG. 3 also shows the position of the spring 4 underneath the inner ring 2 before the inner ring 2 is turned by the holder piece 1 as well as showing the position the inner ring 2 will be in after the spring 4 pulls the inner ring 2 back after it being turned by the pulling of holder piece 1 through the slit on the side wall of the inner chamber and on the side of the paint can. Referring to FIG. 4 is a frontal view of the embedded paint can lid removal device with the segment piece with T-shaped top 5 pushing up against the elastic material covering 6, which pushes the paint lid upwards and out of the hold of the paint can's rim. Referring to FIG. 4 also shows you another side view of the hole with L-shaped indents 8. Referring to FIG. 4 and FIG. 2 also shows you how the inner chamber 7 is shaped inside the paint can, where one of it's walls is connected with the paint and the other wall and the bottom is protecting the inside of the inner chamber from the paint, and also how inner ring 2 is connected to the sides of the inner chamber 7 through slits on it's walls. Referring to FIG. 5 is a side view of the embedded paint can lid removal device showing the position of the wedge piece 3 pushing the segment piece with T-shaped top 5 past the rim of the top of the inner chamber (the paint can rim) and pushing the elastic material covering 6 upwards as well as the paint lid being pushed upwards and out of the hold of the paint can rim's grip after the inner ring 2 has been turned by the holder piece through the slit on the side wall of the inner chamber and on the side of the paint can. Referring to FIG. 5 also shows which position the spring 4 is after the inner ring 2 is turned by the holder piece 1 as well showing the side views of the hole with L-shaped indents 8.

DETAILED DESCRIPTION OF THE INVENTION

This invention is a device that will be built into a paint can that will be used to pry open the lid when other tools aren't available. This will be accomplished by segment pieces, placed in holes in the rim with L-shaped indents going around the holes, and will be pushed upwards from the lower middle part of the interior of the rim. The segment piece will be pushed from a wedge piece underneath those pieces connected to an inner ring which will have a holder piece connected to it's side which will pass through to a slit on the side of the paint can. When the holder piece is pulled, the holder piece and all connected parts will cause the segment pieces to go upwards causing the lid to be removed from the container, but not push the segment piece past the L-shaped indent, keeping the segment piece going up and down linearly. The L-shaped indent will also prevent the outer segment piece from falling into the device by catching the extensions coming out of the top of the T-shaped segment piece which will be aligned with the L-shaped indents. There will also be an elastic material like rubber that will be molded into the top chamber to prevent paint from spilling into the cracks between the segment piece and the L-shaped indents. This elastic material will also push the segment piece back down after being pushed upwards by the wedges form the inner ring and the spring connected between the bottom of the inner ring and the top of the floor of the inner chamber will pull the inner ring and holder piece back into it's original position.

I claim:

1. An embedded paint can lid removal device, comprising:

an inner chamber with holes at the top with greased L-shaped indentations going around an inside top part of the holes to prevent segment pieces from falling through, also having two greased slits circumferentially around the middle of an inner side wall, holding an inner ring having separate slits passing through both the paint can wall, and the side wall of the inner chamber, for an extension of a holder piece to go through both a paint can wall, and the side wall of the inner chamber for an extension of the holder piece to go through;

a coil spring pushing said inner ring forward for removing a paint can lid;

T-shaped segment pieces with triangle-shaped wedges at the bottom of said segment pieces;

said inner ring with wedge shaped parts on top and an extension part for a holder piece connected to the side of the ring extending outside the paint can through a slit on the inner chamber wall; and, an elastic material covering over the top of said lid removal device.

2. The device of claim 1, wherein said inner chamber is an annular shaped ring which will house all other said parts and will be connected to the paint can, via welding, to the top inner corner of the paint can, where the rim of the paint can would normally be, and will require slits on the sides of the inner chamber for the inner ring to be placed into, and these slits will be greased to allow the inner ring to slide back and forth when pulled by the connected holder piece and there will be a slit on the wall facing the paint can's inner wall for the holder piece to go through and the top of the inner chamber will have a curved indent going downward through the middle of the top of the inner chamber and will connect the paint can's lid to the paint can and in the middle of the curved indent there will be holes with greased L-shape indents coming down from the top of the hole to the bottom of the top of the inner chamber, and the L-shaped indents will go around the sides of the hole surrounding the segment pieces' T-shaped extensions and the indented curve will have elastic material covering the top the indented curve of the inner chamber.

3. The device of claim 1, wherein said segment pieces will have extensions in the shape of a T and have a triangle shape at the bottom and will fill the hole with L-shaped indents and the top of the piece will be lined up with lower flat part of the circular indent of the top of the chamber, and the L-shaped indents will keep the segment pieces going up and down linearly since the wedge on the inner ring will only push the segment piece half way up the L-shaped indents and out of the holes, keeping the top of the T-shape extension in contact with the L-shaped indents, but the distance of the segment pieces that are being pushed up, must be enough to push the paint can lid out of the grip of the paint can rim's curved indent and the L-shaped indents' inner walls, which make contact with the T-shaped extensions, will be greased to allow the sliding of the segment pieces up and down.

4. The device of claim 1, wherein said inner ring is connected inside two greased slits, one slit being in the side wall of the inner chamber which will be connected to the paint can and the other slit on the inside of the inner wall of the inner chamber, which both slits will circumference the middle of each wall and on the side of the inner ring that is facing the outside of the paint can, there will be an extension for a holder piece that will extend out of the inner ring through a slit in the inner chamber's wall facing the outside of the paint can and through a slit on the side of the paint can, and be connected via a hinge to the holder piece and the top of the inner ring will have triangle shaped wedges, circumference the middle of the ring which will make contact with the wedges on the bottom of the segment pieces when the inner ring is turned by the holder piece.

5. The device of claim 1, wherein said coil spring will be inside the space between the bottom of the inner ring and the floor of the inner chamber and the coil spring will be connected on one end to the middle of the bottom of the inner ring and on the other end to the middle of the bottom of the inner chamber and be connected on both ends via welding which will allow the inner ring to jump back into place and be held in place by the extension to the holder piece making contact with one of the ends of the slit on the side of both the inner chamber and the paint can.

6. The device of claim 1, wherein said holder piece will consist of a hinge connected to the inner ring by an extension from the inner ring going through slits on both the side of the inner wall of the inner chamber facing the paint can and when the holder piece is pulled, this will cause the inner ring to move, causing the wedges on the inner ring to make contact with the segment piece from the top of the chamber and the inner ring will move the wedge piece forward causing the outer segment piece to be pushed upwards causing the outer segment piece to push the paint can's lid out of the curved indent on the top of the inner chamber, opening up the paint can and the slit on the side of both the paint can and the inner chamber wall will only be big enough for the holder piece to pull the inner ring forward enough of a distance to make sure the T-shaped extensions do not go past the L-shaped indents but will allow the wedges and the segment pieces to make enough contact to allow the segment pieces to push out the paint can lid from the paint can rim's grip and the segment piece will then be pulled back down by the elastic piece covering the top of the circular indent of the inner chamber and the inner ring will be pulled back by the coil spring.

7. The device of claim 1, wherein said elastic material will be bonded into the middle or over the top of the curved indent of the top of the inner chamber of the device covering the segment pieces to protect against paint getting into the cracks between the segment pieces and the L-shaped indents and bonding must allow enough space between the elastic material and the segment pieces tops, to allow the segment pieces to go up their full length that is required to push out the paint can's lid.

* * * * *